US005858638A

United States Patent [19]

Maskasky et al.

[11] Patent Number: 5,858,638

[45] Date of Patent: Jan. 12, 1999

[54] PROCESS FOR THE PREPARATION OF HIGH CHLORIDE (100) TABULAR GRAIN EMULSIONS

[75] Inventors: Joe E. Maskasky; Victor P. Scaccia, both of Rochester; Samuel Chen, Penfield, all of N.Y.

[73] Assignee: Eastman Kodak Company, Rochester, N.Y.

[21] Appl. No.: 960,551

[22] Filed: Oct. 31, 1997

[51] Int. Cl.[6] ..... G03C 1/015; G03C 1/035

[52] U.S. Cl. ..... 430/569; 430/567

[58] Field of Search ..... 430/567, 569

[56] References Cited

U.S. PATENT DOCUMENTS

| | | | |
|---|---|---|---|
| 5,264,337 | 11/1993 | Maskasky | 430/567 |
| 5,292,632 | 3/1994 | Maskasky | 430/567 |
| 5,320,938 | 6/1994 | House et al. | 430/567 |
| 5,358,842 | 10/1994 | Kasai et al. | 430/569 |
| 5,413,904 | 5/1995 | Chang et al. | 430/569 |

*Primary Examiner*—Mark F. Huff
*Attorney, Agent, or Firm*—Carl O. Thomas

[57] ABSTRACT

A process is disclosed of precipitating a high chloride {100} tabular grain photographic emulsion in which iodide incorporation in previously formed grain nuclei is relied upon to create the crystal lattice defects responsible for tabular grain growth. Undesirable dilution of the emulsion is avoided by replacing soluble iodide salt solution addition with iodine solution addition, allowing the volume of the iodine solution to be limited to less than 10 percent of the emulsion volume at the conclusion of tabular grain growth.

9 Claims, No Drawings

PROCESS FOR THE PREPARATION OF HIGH CHLORIDE (100) TABULAR GRAIN EMULSIONS

FIELD OF THE INVENTION

The invention relates to a process for the preparation of radiation sensitive silver halide emulsions for use in photography.

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and an aspect ratio of at least 2.

The term "tabular grain emulsion" refers to an emulsion in which tabular grains account for greater than 50 percent of total grain projected area.

The term "high chloride" in referring to grains and emulsions indicates that chloride is present in a concentration of greater than 50 mole percent, based on total silver.

In referring to grains and emulsions containing two or more halides, the halides are named in order of ascending concentrations.

The term "{100} tabular" is employed in referring to tabular grains and tabular grain emulsions containing tabular grains having {100} major faces.

The term "gelatino-peptizer" is employed in its art recognized sense to designate gelatin (e.g., cattle bone or hide gelatin, acid-treated gelatin (e.g., pigskin gelatin), or a gelatin derivative (e.g., actylated or phthlated gelatin).

The term "post-nucleation stage" in referring to grain precipitation refers to the period following grain nuclei formation extending up to introduction of the first 3 percent of total silver.

The term "vAg" indicates the potential difference in volts between a standard reference electrode (Ag/AgCl with 4 molar KCl at room temperature) in a 4 molar KCl salt bridge and an anodized Ag/AgCl indicator electrode.

*Research Disclosure* is published by Kenneth Mason Publications, Ltd., Dudley House, 12 North St., Emsworth, Hampshire P010 7DQ, England.

RELATED APPLICATIONS

Mehta U.S. Ser. No. 08/748,231, filed Nov. 12, 1996, titled A PROCESS FOR THE PREPARATION OF HIGH CHLORIDE {100} TABULAR GRAIN EMULSIONS, commonly assigned, modifies iodide incorporation at or near grain nucleation by adding an organic, iodide releasing compound.

Maskasky, Scaccia and Chen U.S. Ser. No. 08/819,231, filed Mar. 17,1997, titled PROCESS FOR THE PREPARATION OF SILVER HALIDE EMULSIONS HAVING IODIDE CONTAINING GRAINS, commonly assigned, discloses a process of preparing iodohalide grains wherein iodide ion is introduced into the crystal lattice structure by introducing elemental iodine into the dispersing medium and maintaining the dispersing medium within a pH range of from 5 to 8.

Maskasky, Scaccia and Chen U.S. Ser. No. 08/955,867, filed Oct. 21, 1997, titled HIGH CHLORIDE TABULAR GRAIN EMULSIONS AND PROCESSES FOR THEIR PREPARATION, discloses a process of creating peripheral crystal lattice dislocations in high chloride {100} tabular grains by introducing elemental iodine prior to the final stage of tabular grain growth.

BACKGROUND

Maskasky U.S. Pat. Nos. 5,264,337 and 5,292,632, hereinafter collectively referred to as Maskasky, disclose high chloride {100} tabular grain emulsions. The {100} tabular grains of Maskasky were "internally free of iodide", which is employed to mean no iodide ion is intentionally incorporated in the grains during their nucleation and growth prior to achieving their required tabular grain characteristics—i.e., prior to achieving an aspect ratio of at least 2. Maskasky in most instances relied upon as a grain growth stabilizer an organic compound containing a nitrogen atom with a resonance stabilized $\pi$ electron pair, although Example 2 ('337) Example 6 ('632) demonstrate that such a grain growth stabilizer is not essential.

Subsequently House et al U.S. Pat. No. 5,320,938 was able to demonstrate thinner and higher aspect ratio high chloride {100} tabular grain emulsions than demonstrated by Maskasky by performing grain nucleation in the presence of iodide ion. No restraining agents of the type disclosed by Maskasky were employed.

Chang et al U.S. Pat. No. 5,413,904 improved on the process of House et al by delaying iodide ion addition until after grain nuclei formation. By delaying iodide addition until after at least 0.01 percent of the total silver had been precipitated, Chang et al was able to significantly reduce the proportion of grains other than high chloride {100} tabular grains present in the emulsion. Additionally, the modified process was more robust, meaning that the process required minimum adjustments when the scale and equipment of precipitation was varied.

PROBLEM TO BE SOLVED

Although the process of Chang et al was more robust and increased the proportion of high chloride {100} tabular grains created by iodide addition, a difficulty was created by the necessity of introducing a soluble iodide salt solution into the reaction vessel following grain nucleation. The extreme reactivity of the iodide ions in the salt solution creates a difficulty in uniformly distributing the iodide ion within the dispersing medium containing the grain nuclei. Chang et al overcame this difficulty by diluting the soluble iodide salt solution added. Specifically, Chang et al discloses no iodide salt solution addition having a volume of less than 45 percent of the final volume of the high chloride {100} emulsion at the conclusion of grain growth. This, of course, reduces the emulsion yield, based on silver, from a reactor by a factor of almost 2. Thus, while Chang et al improved process robustness and overall grain properties, these advantages were achieved at the expense of almost doubling the volume of dispersing medium forming a given amount of emulsion, based on silver.

SUMMARY OF THE INVENTION

It is an object of this invention to provide an improvement on the process of producing high chloride {100} tabular grain emulsions taught by Chang et al. Specifically, the process of the invention has as its purpose to reduce emulsion dilution attributable to providing iodide ion in the dispersing medium following grain nucleation.

It has been discovered quite unexpectedly that the advantage of the invention can be realized by modifying the manner in which iodide ion is made available during the post-nucleation stage of grain precipitation.

In one aspect this invention is directed to a process of precipitating a photographic emulsion containing silver halide grains comprised of iodide and at least 50 mole percent chloride, with tabular grains having {100} major faces accounting for greater than 50 percent of total grain projected area, comprised of the steps of (1) separately introducing soluble silver and halide salts into an aqueous dispersing medium containing a gelatino-peptizer so that grain nuclei are formed while the dispersing medium is maintained at a pCl in the range of from 0.5 to 3.5, the halide being at least 50 mole percent chloride, based on silver, with any remaining halide being bromide, and (2) following step (1) completing grain growth under conditions that form the {100} major faces of the tabular grains, wherein, prior to step (2), (a) a solution containing elemental iodine is introduced into the dispersing medium, the iodine solution having a volume that is less than 10 percent the volume of the emulsion at the conclusion of step (2), (b) after 0.01 percent and before 3 percent of total silver has been introduced, the iodine is converted to iodide ion, and (c) the iodide is incorporated into the grain nuclei to create crystal lattice defects that promote the growth of {100} tabular grains during step (2).

DESCRIPTION OF PREFERRED EMBODIMENTS

The process of the present invention can be viewed as a modification of the processes disclosed by Chang et al, cited above and here incorporated by reference, wherein a modification is undertaken of the manner in which iodide ion is made available for incorporation of grain nuclei following their formation—that is, after 0.01 percent and before 3 percent of total silver forming the grains has been introduced. Instead of introducing iodide ion in the form of simple inorganic salts, such as an alkali or alkaline earth iodide, which dissociate into component ions immediately upon introduction into the dispersing medium, the present invention contemplates release of iodide ion into the dispersing medium at a controlled rate. It has been observed quite unexpectedly that by employing elemental iodine as a source of iodide ion during the post-nucleation stage of precipitation allowing iodide ion generation to be delayed until after elemental iodine has been introduced and well distributed within the dispersing medium, the dilution of the dispersing medium required by Chang et al can be dramatically reduced. Whereas Chang et al introduced greater than 45 percent of the total volume of the final emulsion while introducing soluble iodide salt following grain nucleation, the elemental iodine is introduced dissolved in a solution amounting to less than 10 (preferably less than 1) percent of the volume of the emulsion at the conclusion of the grain growth step.

The incorporation of iodide into the grain nuclei at the postnucleation stage of precipitation is conducted in three steps: (a) elemental iodine ($I^{\circ}$) is introduced into the dispersing medium, (b) after 0.01 percent and before 3 percent of total silver used to form a high chloride {100} tabular grain emulsion has been introduced into the reaction vessel in which the emulsion is being prepared, the iodine is converted to iodide ion ($I^-$), and (c) the iodide is precipitated with silver ions onto grain nuclei to create crystal lattice defects that promote the growth of {100} tabular grains during subsequent grain growth.

Step (b) occurs spontaneously after commencing iodine addition to the dispersing medium within the reaction vessel. The conversion of iodine to iodide does not occur instantaneously, but is usually observed to go to completion in a matter of minutes.

Upon iodine addition, the elemental iodine is converted to iodide ion by reacting the iodine with a mild reducing agent that is incapable of reducing (fogging) the grains (i.e., incapable of reducing $Ag^+$ to $Ag^{\circ}$ under the conditions of precipitation). The conversion of iodine to iodide occurs at a pH at or above 3.5 and is preferably undertaken at a pH of from 3.5 to 8, which is sufficiently low to eliminate reduction fog. Preferably the pH is kept on the acid side of neutrality—that is, at a pH of <7.0. The removal of iodide ion from the dispersing medium in step (c) acts as a driving force for iodine reduction, allowing the water in the dispersing medium to act as the reducing agent for the step (b) conversion of iodine to iodide. Therefore no reducing agent stronger than water is required.

The iodine to iodide conversion can be monitored by observing the pH, since this reaction releases hydrogen ions into the dispersing medium. Preferably a base, such as sodium or potassium hydroxide, is added as required to maintain a constant pH. Slowing of the rate of base addition while maintaining a constant pH indicates that the iodine to iodide conversion is nearing completion.

Spontaneously, following the conversion of iodine to iodide, step (c) occurs.

The overall process of preparing a high chloride {100 } tabular grain emulsion is comprised of a grain nucleation step (1), wherein soluble silver and halide salts are separately introduced into an aqueous dispersing medium containing a gelatino-peptizer while the dispersing medium is maintained at a pCl in the range of from 0.5 to 3.5 and a growth step (2), wherein growth onto the grain nuclei created in step (1) results in high chloride {100} tabular grains. Iodine introduction to create the iodide ion necessary to promote {100} tabular grain growth occurs prior to step (2) according to steps (a), (b) and (c), set forth above.

The process of the invention does not require the use of an aromatic grain growth stabilizer containing a nitrogen atom having a resonance stabilized p electron pair of the type disclosed by Maskasky. In the preferred practice of the invention grain growth stabilizers are absent.

The elemental iodine is used to introduce iodide ion into the reaction vessel during the post-nucleation stage of precipitation, as taught by Chang et al. The inclusion of iodide into the cubic crystal lattice of the grain nuclei is disruptive because of the much larger diameter of iodide ion as compared to chloride ion. The incorporated iodide ions introduce crystal irregularities. The modifications of the grain nuclei crystal lattice structure results in the grains growing into tabular grains rather than regular (cubic) grains.

At the outset of precipitation the reaction vessel is loaded with a dispersing medium containing a gelatino-peptizer and equipped with conventional silver and reference electrodes for monitoring halide ion concentrations within the dispersing medium. Halide ion is introduced into the dispersing medium that is at least 50 mole percent chloride, based on silver, with any remaining halide being bromide. In other words, prior to iodide incorporation, the grain nuclei formed in step (1) consist essentially of silver chloride or silver bromochloride. The pCl of the dispersing medium is adjusted to favor the formation of {100} grain faces on nucleation—that is, within the range of from 0.5 to 3.5, preferably within the range of from 1.0 to 3.0 and, optimally, within the range of from 1.5 to 2.5.

Grain nucleation step is initiated when a silver jet is opened to introduce silver ion into the dispersing medium. Iodide ion is withheld from the dispersing medium until after grain nucleation. However, introducing iodine into the dispersing medium inherently delays iodide ion availabbility. Therefore, the advantages observed by Chang et al attributable to iodide ion addition delay can be realized in the practice of the invention without delaying elemental iodine addition. Nevertheless iodine introduction is preferably delayed until the post-nucleation stage at which the presence of iodide is required. Preferably at least 0.005 percent of total silver used to form the emulsion has been introduced into the dispersing medium before iodide ion is present. Preferred results are realized when iodine introduction is initiated in the post-nucleation period following precipitation of from 0.01 to 3 (optimally 1.5) percent of total silver.

Tabular grain growth can occur over a wide range of iodide ion concentrations ranging up to the saturation limit of iodide in silver chloride. The saturation limit of iodide in silver chloride is reported by H. Hirsch, "Photographic Emulsion Grains with Cores: Part I. Evidence for the Presence of Cores", J. of Photog. Science, Vol. 10 (1962), pp. 129–134, to be 13 mole percent. In silver halide grains in which equal molar proportions of chloride and bromide ion are present up to 27 mole percent iodide, based on silver, can be incorporated in the grains. It is contemplated to undertake grain growth below the iodide saturation limit to avoid the precipitation of a separate silver iodide phase and thereby avoid creating an additional category of unwanted grains. It is generally preferred to maintain the iodide ion concentration after its delayed introduction into the dispersing medium at the outset of nucleation at less than 10 mole percent. In fact, only minute amounts of iodide are required to achieve the desired tabular grain population. Concentrations of iodide down to 0.001 mole percent, based on total silver in the precipitated grains, are contemplated. For convenience in replication of results, it is preferred to introduce sufficient iodide in the post-nucleation stage of precipitation to provide an iodide concentration of at least 0.005 mole percent and, optimally, at least 0.07 mole percent, based on total silver, in the fully precipitated grains.

In a preferred method silver chloride grain nuclei are formed at the outset of the nucleation step. Minor amounts of bromide ion can be present also in the dispersing medium at the outset of nucleation. Any amount of bromide ion can be present in the dispersing medium at the outset of nucleation and subsequently that is compatible with at least 50 mole percent of the halide in the grain nuclei being chloride ions. The grain nuclei preferably contain at least 70 mole percent and optimally at least 90 mole percent chloride ion, based on silver.

Grain nuclei formation occurs instantaneously upon introducing silver ion into the dispersing medium. Precipitation under the initial conditions in the reaction vessel—i.e., step (1) conditions—can be terminated at any time after the minimum iodide addition described above has been completed. Since silver iodide is much less soluble than silver chloride, any iodide ion created by addition of elemental iodine into the dispersing medium precipitates instantaneously. For manipulative convenience and reproducibility, silver ion introduction under step (1) conditions is preferably extended for a convenient period, typically from 5 seconds to less than 2 minutes, and typically during this period from about 0.1 to 10 mole percent of total silver is introduced into the dispersing medium. So long as the pCl remains within the ranges set forth previously no additional chloride ion need be added to the dispersing medium during step (1). It is, however, preferred to introduce both silver and chloride salts concurrently during this step. The advantage of adding chloride salts concurrently with silver salt throughout step (1) is that the variation of pCl within the dispersing medium can be minimized or eliminated. If desired, bromide salts can be introduced as well. Once sufficient iodide ion release has occurred to assure tabular grain growth, further iodide is not required. Thus, further iodine introduction in either or both of step (1) and the subsequent growth step, step (2), is a matter of preference only and can be based on well known photographic performance considerations.

Any convenient conventional choice of soluble silver, chloride and bromide salts can be employed during steps (1) and (2). While iodine is employed as a source of iodide in step (1), it is appreciated that iodine or any conventional source of iodide ion (e.g., an iodide salt of the type employed by House et al and Chang et al) can be employed in step (2). Silver ion is preferably introduced as an aqueous silver salt solution, such as a silver nitrate solution. Halide salt solutions can take the form alkali or alkaline earth halide, such as lithium, sodium, potassium and/or calcium chloride, bromide and/or iodide.

The dispersing medium contained in the reaction vessel prior to nucleation is comprised of water, the halides in the concentrations and forms discussed previously, and the gelatino-peptizer. Except as restricted during iodine addition and conversion to iodide as noted above, the dispersing medium can exhibit a pH within any convenient conventional range for silver halide precipitation. It is preferred to remain throughout the process at a pH of less than 8.5 and, most preferably less than 7.0. Only when iodide ion is being created from iodine is a pH of at least 3.5 required. At other times a preferred minimum pH as low as 2.0 is contemplated.

Generally at least about 10 percent and typically from 20 to 80 percent of the dispersing medium forming the completed emulsion is present in the reaction vessel at the outset of the nucleation step. It is conventional practice to maintain relatively low levels of gelatino-peptizer, typically from 10 to 20 percent of the peptizer present in the completed emulsion, in the reaction vessel at the start of precipitation. To increase the proportion of thin ($t<0.2\ \mu m$) tabular grains having {100} faces formed during nucleation, it is preferred that the concentration of the gelatino-peptizer in the dispersing medium be in the range of from 0.5 to 6 percent by weight of the total weight of the dispersing medium at the outset of the nucleation step. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete.

Step (1) can be performed at any convenient conventional temperature for the precipitation of silver halide emulsions. Temperatures ranging from near ambient—e.g., 30° C. up to about 90° C. are contemplated, with nucleation temperatures in the range of from 35° to 7° C. being preferred.

During the grain growth step, step (2), the grain nuclei are grown until tabular grains having {100} major faces of a desired average equivalent circular diameter (ECD) are obtained. Whereas the objective of step (1) is to form a grain population having the necessary incorporated crystal structure irregularities to promote tabular grain growth, the objective of step (2) is to deposit additional silver halide onto (grow) the existing grain population while avoiding or minimizing the formation of additional grains. If additional grains are formed during the growth step, the polydispersity of the emulsion is increased and, unless conditions in the reaction vessel are maintained as described above for the nucleation step, the additional grain population formed in the growth step will not have the desired tabular grain properties described herein for use in the invention.

In its simplest form the process of preparing the desired emulsions can be performed as a single jet precipitation without interrupting silver ion introduction from start to finish, optionally modified by providing a second jet for the delayed introduction of elemental iodine in solution. In other words all chloride and/or bromide ions are in the dispersing medium at the outset of precipitation while the elemental iodine is added later, as required for the delayed presence of iodide ion. As is generally recognized by those skilled in the art, a spontaneous transition from grain formation to grain growth occurs even with an invariant rate of silver ion introduction, since the increasing size of the grain nuclei increases the rate at which they can accept silver and halide ion from the dispersing medium until a point is reached at which they are accepting silver and halide ions at a sufficiently rapid rate that no new grains can form. Although manipulatively simple, the modified single jet precipitation procedure limits halide content and profiles and generally results in more polydisperse grain populations.

It is preferred to employ a balanced double jet precipitation technique in which silver ions and halide ions are concurrently introduced into the dispersing medium. If the elemental iodine is introduced in the chloride ion containing solution through a single halide introduction jet, the halide jet can be turned on after silver ion introduction has commenced, and the chloride in the dispersing medium can be relied upon at the outset of nucleation, thereby allowing iodide ion to be generated within the dispersing medium within the reaction vessel after grain nucleation has been initiated. Alternatively, a separate jet can be provided to introduce the elemental iodine in solution. Iodine is conveniently added dissolved in a water miscible solvent, such as methyl or ethyl alcohol or dimethylformamide, which can also optionally contain water.

It is specifically sought to prepare the high chloride {100} tabular grain emulsions with the most geometrically uniform grain populations attainable, since this allows a higher percentage of the total grain population to be optimally sensitized and otherwise optimally prepared for photographic use. Further, it is usually more convenient to blend relatively monodisperse emulsions to obtain aim sensitometric profiles than to precipitate a single polydisperse emulsion that conforms to an aim profile.

One technique for increasing grain monodispersity is to interrupt silver and halide salt introductions at the earliest convenient time after a stable population of grain nuclei have been formed. The emulsion is held within the temperature ranges described above for step (1) for a period sufficient to allow reduction in grain dispersity. A holding period can range from a minute to several hours, with typical holding periods ranging from 5 minutes to an hour. During the holding period relatively smaller grain nuclei are Ostwald ripened onto surviving, relatively larger grain nuclei, and the overall result is a reduction in grain dispersity.

If desired, the rate of ripening can be increased by the presence of a ripening agent in the emulsion during the holding period. A conventional simple approach for accelerating ripening is to increase the halide ion concentration in the dispersing medium. This creates complexes of silver ions with plural halide ions that accelerate ripening. When this approach is employed, it is preferred to increase the chloride ion concentration in the dispersing medium. That is, it is preferred to lower the pCl of the dispersing medium into a range in which increased silver chloride solubility is observed. Alternatively, ripening can be accelerated and the percentage of total grain projected area accounted for by {100} tabular grains can be increased by employing conventional ripening agents. Preferred ripening agents are sulfur containing ripening agents, such as thioethers and thiocyanates. Typical thiocyanate ripening agents are disclosed by Nietz et al U.S. Pat. No. 2,222,264, Lowe et al U.S. Pat. No. 2,448,534 and Illingsworth U.S. Pat. No. 3,320,069, the disclosures of which are here incorporated by reference. Typical thioether ripening agents are disclosed by McBride U.S. Pat. No. 3,271,157, Jones U.S. Pat. No. 3,574,628 and Rosencrantz et al U.S. Pat. No. 3,737,313, the disclosures of which are here incorporated by reference. More recently crown thioethers have been suggested for use as ripening agents. Ripening agents containing a primary or secondary amino moiety, such as imidazole, glycine or a substituted derivative, are also effective. Sodium sulfite has also been demonstrated to be effective in increasing the percentage of total grain projected accounted by the {100} tabular grains.

Once the desired population of grain nuclei have been formed, the introduction of silver and, preferably, halide can be reinstituted. In most instances iodine to iodide conversion is completed or at least commenced prior to the precipitation interruption and hold period described. Hence generally the interruption and hold occur at the end of step (1) and before commencing step (2).

Grain growth in step (2) can proceed according to any convenient conventional precipitation technique for the precipitation of silver halide grains bounded by {100} grain faces. Whereas iodide ions provided from elemental iodine are required to be incorporated into the grains during step (1) and are therefore present in the completed grains, any halide or combination of halides known to form a cubic crystal lattice structure can be employed during the growth step. Once the minimum iodide and chloride grain concentrations are satisfied, neither iodide nor chloride ions need be incorporated subsequently into the grains.

It has been observed that bromide additions during grain growth in the range of from 0.05 to 15 mole percent, preferably from 1 to 10 mole percent, based on silver, produce relatively thinner {100} tabular grains than can be realized under the same conditions of precipitation in the absence of bromide ion. Similarly, it has been observed that iodide additions during the growth step in the range of from 0.001 to <1 mole percent, based on silver, produce relatively thinner {100} tabular grains than can be realized under the same conditions of precipitation in the absence of iodide ion.

During step (2) both silver and halide salts are preferably introduced into the dispersing medium. In other words, double jet precipitation is contemplated, with added iodide, if any, being introduced with the remaining halide salt or through an independent jet. The rate at which silver and halide are introduced is controlled to avoid renucleation—that is, the formation of a new grain population. Addition rate control to avoid renucleation is generally well known in the art, as illustrated by Wilgus German OLS No. 2,107,118, Irie U.S. Pat. No. 3,650,757, Kurz U.S. Pat. No. 3,672,900, Saito U.S. Pat. No. 4,242,445, Teitschied et al European Patent Application 80102242, "Growth Mechanism of AgBr Crystals in Gelatin Solution", *Photographic Science and Engineering*, Vol. 21, No. 1, January/Febuary 1977, p. 14, et seq.

In the simplest form of the grain preparation the nucleation and growth stages—e.g., steps (1) and (2) of grain precipitation occur in the same reaction vessel. It is, however, as noted above grain precipitation can be interrupted, typically and most conveniently at the conclusion of step (1). Further, two separate reaction vessels can be substituted for the single reaction vessel described above. Step (1) can be performed in an upstream reaction vessel (herein also termed a nucleation reaction vessel) and the dispersed grain nuclei can be transferred to a downstream reaction vessel in which step (2) of grain precipitation occurs (herein also termed a growth reaction vessel). In one arrangement of this type an enclosed nucleation vessel can be employed to receive and mix reactants upstream of the growth reaction vessel, as illustrated by Posse et al U.S. Pat. No. 3,790,386, Forster et al U.S. Pat. No. 3,897,935, Finnicuim et al U.S. Pat. No. 4,147,551, and Verhille et al U.S. Pat. No. 4,171,224, here incorporated by reference. In these arrangements the contents of the growth reaction vessel are recirculated to the nucleation reaction vessel.

It is herein contemplated that various parameters important to the control of grain formation and growth, such as pH, pCl, ripening, temperature, and residence time, can be independently controlled in the separate nucleation and growth reaction vessels. To allow grain nucleation to be entirely independent of grain growth occurring in the growth reaction vessel downstream of the nucleation reaction vessel, no portion of the contents of the growth reaction vessel should be recirculated to the nucleation reaction vessel. Preferred arrangements that separate grain nucleation from the contents of the growth reaction vessel are disclosed by Mignot U.S. Pat. No. 4,334,012 (which also discloses the useful feature of ultrafiltration during grain growth), Urabe U.S. Pat. No. 4,879,208 and published European Patent Applications 326,852, 326,853, 355,535 and 370,116, Ichizo published European Patent Application 0 368 275, Urabe et al published European Patent Application 0 374 954, and Onishi et al published Japanese Patent Application (Kokai) 172,817-A (1990).

The manufacturing advantages of the process of the invention can be realized while preparing the most desirable high chloride {100} tabular grain characteristics taught by House et al and Chang. The high chloride {100} tabular grains can account for greater than 95 percent of total grain projected area. In specifically preferred emulsions produced by the process of the invention the high chloride {100} tabular grains account for greater than 97 percent of total grain projected area. In optimized emulsions according to this invention the high chloride {100} tabular grains account for substantially all (>99%, based on projected area) of the grain population. Further, obtaining these high percentages of projected area provided by high chloride {100} tabular grains is compatible with retaining the low tabular grain thicknesses and thickness dependent features (e.g., average aspect ratio) disclosed by House et al and Chang.

Since by definition a grain must have an aspect ratio of at least 2 to be considered tabular, the average aspect ratio of the high chloride {100} tabular grains can only approach 2 as a lower limit. In fact, the tabular grain emulsions produced by the process of this invention typically exhibit average aspect ratios of 5 or more, with average aspect ratios greater than 8 being preferred. That is, preferred emulsions prepared by the processes of the invention are high aspect ratio tabular grain emulsions. In specifically preferred emulsions, average aspect ratios of the tabular grain population are at least 12 and optimally at least 20. Typically the average aspect ratio of the tabular grain population ranges up to 50, but higher average aspect ratios of 100, 200 or more can be realized. Emulsions in which the average aspect ratio approaches the minimum average aspect ratio limit of 2 still provide a surface to volume ratio that is 133 percent that of cubic grains.

The tabular grain population can exhibit any grain thickness that is compatible with the average aspect ratios noted hereinbefore. However, when the high chloride {100} tabular grains accounting for at least 50 percent of the total grain projected area, hereinafter referred to as the selected grain population, exhibits a high average aspect ratio, it is preferred to additionally limit the grains included in the selected tabular grain population to those that exhibit a thickness of less than 0.3 $\mu$m and, optimally, less than 0.2 $\mu$m. It is appreciated that the aspect ratio of a tabular grain can be limited either by limiting its equivalent circular diameter or increasing its thickness. Thus, when the average aspect ratio of the tabular grain population is in the range of from 2 to 8, the tabular grains accounting for at least 50 percent of total grain projected area can also each exhibit a grain thickness of less than 0.3 $\mu$m or less than 0.2 $\mu$m. Nevertheless, in the aspect ratio range of from 2 to 8 particularly, there are specific benefits that can be gained by greater tabular grain thicknesses. For example, in constructing a blue recording emulsion layer of maximum achievable speed it is specifically contemplated that tabular grain thicknesses that are on average 1 $\mu$m or even larger can be used. This is because the eye is least sensitive to the blue record and hence higher levels of image granularity (noise) can be tolerated without objection. There is an additional incentive for employing larger grains in a blue record since it is sometimes difficult to match in the blue record the highest speeds attainable in the green and red record. A source of this difficulty resides in the blue photon deficiency of sunlight. While sunlight on an energy basis exhibits equal parts of blue, green and red light, at shorter wavelengths the photons have higher energy. Hence on a photon distribution basis daylight is slightly blue deficient.

The tabular grain population preferably exhibits major face edge length ratios of less than 5 and optimally less than 2. The nearer the major face edge length ratios approach 1 (i.e., equal edge lengths) the lower is the probability of a significant rod population being present in the emulsion. Further, it is believed that tabular grains with lower edge ratios are less susceptible to pressure desensitization.

In one specifically preferred form the tabular grain population accounting for at least 50 percent of total grain projected area is provided by tabular grains also exhibiting 0.2 $\mu$m thicknesses. In other words, the emulsions are in this instance thin tabular grain emulsions.

A significant feature of the emulsion preparation technique described herein is that it can be used to provide ultrathin tabular grain emulsions satisfying the requirements needed for use in the color photographic elements of the invention. Ultrathin tabular grain emulsions are those in which the selected tabular grain population is made up of tabular grains having thicknesses of less than 0.07 $\mu$m. Emulsions prepared as described herein can have a tabular grain population with a mean thickness down to 0.02 $\mu$m. Ultrathin tabular grains have extremely high surface to volume ratios. This permits ultrathin grains to be photographically processed at accelerated rates. Further, when spectrally sensitized, ultrathin tabular grains exhibit very high ratios of speed in the spectral region of sensitization as compared to the spectral region of native sensitivity. For example, the ultrathin tabular grain emulsions described herein can have entirely negligible levels of blue sensitivity, and are therefore capable of providing a green or red record in a color photographic element that exhibits minimal blue contamination even when located to receive blue light.

The characteristic of tabular grain emulsions that sets them apart from other emulsions is the ratio of grain ECD to thickness (t). This relationship has been expressed quantitatively in terms of aspect ratio. Another quantification that is believed to assess more accurately the importance of tabular grain thickness is tabularity:

$$T=ECD/t^2=AR/t$$

where

T is tabularity;

AR is aspect ratio;

ECD is equivalent circular diameter in micrometers($\mu$m); and t is grain thickness in micrometers.

The selected tabular grain population accounting for 50 percent of total grain projected area as described herein preferably exhibits a tabularity of greater than 25 and most preferably greater than 100. Since the tabular grain population can be ultrathin, it is apparent that extremely high tabularities, ranging to 1000 and above are within the contemplation of our invention.

The tabular grain population can exhibit an average ECD of any photographically useful magnitude. For photographic utility average ECD's of less than 10 $\mu$m are contemplated, although average ECD's of the tabular grain emulsions used in this invention rarely exceed 6 $\mu$m. Within ultrathin tabular grain emulsions satisfying the requirements of the invention it is possible to provide intermediate aspect ratios with ECD's of the tabular grain population of 0.10 $\mu$m and less. As is generally understood by those skilled in the art, emulsions with selected tabular grain populations having higher ECD's are advantageous for achieving relatively high levels of photographic sensitivity while selected tabular grain populations with lower ECD's are advantageous in achieving low levels of granularity.

EXAMPLES

The invention can be better appreciated by reference to the following specific embodiments.

Comparison Example 1

Made using KI solution of approximately 50% of the total final emulsion volume for tabular grain nucleation following the process of Chang et. al. U.S. Pat. No. 5,413,904

To a vigorously stirred reaction vessel containing 2,900 mL of a solution that was 11.8 mmolar in NaCl and 4.48 wt % in deionized low methionine bone gelatin (0.1 $\mu$mole methionine per g gelatin) at pH 5.7 and 35° C. was added a 4 M $AgNO_3$ solution at 15 mL per min for 1.6 min and a 4 M NaCl solution at a rate to maintain a vAg of 152 mV (pCl of 1.90). Then 5,600 mL of a solution that contained 26 mmoles of NaCl and 2.3 mmoles of KI was dumped into the emulsion. The mixture was stirred for 5 min, then the 4 M $AgNO_3$ solution was added during 20 min at 10 mL per min and the 4 M NaCl solution was added to maintain a vAg of 175 mV while the temperature was constantly increased to 50° C. During the next 20 min the 4 M $AgNO_3$ solution addition rate was linearly accelerated to 15 mL per min and the temperature was constantly increased to 70° C. and 4 M NaCl solution was added to linearly change the vAg from 175 mV to 155 mV. The additions were stopped and the mixture was held for 15 min. Then during 46 min at 70° C., the 4 M $AgNO_3$ solution was added initially at 10 mL per min and linearly accelerated to 28 mL per min in 46 min and 4 M NaCl solution was added to maintain a vAg of 155 mV. After holding for 30 min at 70° C., the emulsion was cooled to 40° C.

The resulting high chloride {100} tabular grain emulsion contained tabular grains having {100} major faces which made up 93% of the grain projected area of the total grain population. This tabular grain population had an average ECD of 3.5 $\mu$m, an average tabular grain thickness of 0.18 $\mu$m, and an average aspect ratio of 19.

The yield of unwashed emulsion at conclusion of the grain growth step was only 2.0 liters of emulsion per mole Ag.

Example 2

Made using elemental iodine in a small amount of methanol for tabular grain nucleation This emulsion was prepared similarly to that of Comparison Example 1, except that instead of adding 5,600 mL of a solution containing 2.3 mmoles of KI, 15 mL of a methanolic solution containing 3.84 milliequivalents (487 mg) of elemental iodine was added at 5 mL per min while maintaining the pH at 5.7 by the addition of dilute NaOH solution.

The resulting high chloride {100} tabular grain emulsion contained tabular grains having {100} major faces which made up 85% of the projected area of the total grain population. This tabular grain population had an average ECD of 3.8 $\mu$m an average thickness of 0.29 $\mu$m and an average aspect ratio of 13.

The yield of unwashed emulsion at the conclusion of the grain growth step was 1.0 liters of emulsion per mole Ag.

Comparison Example 3

Made using KI in a small amount of water for tabular grain nucleation

This comparison emulsion was made similarly to that of Example 2, except that instead of the 15 mL of a methanolic solution containing 3.84 milliequivalents of elemental iodine, 15 mL of an aqueous solution containing 3.84 mmole of KI was used.

The resulting high chloride {100} tabular grain emulsion contained tabular grains having {100} major faces which made up 65% of the projected area of the total grain population. This tabular grain population had an average ECD of 2.0 $\mu$m, an average thickness of 0.23 $\mu$m and an average aspect ratio of 9.

The yield of unwashed emulsion at the conclusion of the growth step was 1.0 liter of emulsion per mole Ag.

Example 4

Made using elemental iodine in a small amount of methanol for tabular grain nucleation and high methionine bone gelatin as peptizer This emulsion was prepared similarly to that of Example 2, except that the low methionine gelatin was replaced with high methionine bone gelatin (approximately 55 $\mu$mole methionine per g gelatin).

The resulting high chloride {100} tabular grain emulsion contained tabular grains having {100} major faces which made up 90% of the projected area of the total grain population. This tabular grain population had an average ECD of 2.5 $\mu$m, an average thickness of 0.26 $\mu$m and an average aspect ratio of 10.

The yield of unwashed emulsion at the conclusion of the growth step was 1.0 liter of emulsion per mole Ag.

The invention has been described in detail with particular reference to preferred embodiments thereof, but it will be understood that variations and modifications can be effected within the spirit and scope of the invention.

What is claimed is:

1. A process of precipitating a photographic emulsion containing silver halide grains comprised of iodide and at least 50 mole percent chloride, with tabular grains having {100} major faces accounting for greater than 50 percent of total grain projected area, comprised of the steps of (1) separately introducing soluble silver and halide salts into an aqueous dispersing medium containing a gelatino-peptizer so that grain nuclei are formed while the dispersing medium is maintained at a pCl in the range of from 0.5 to 3.5, the halide being at least 50 mole percent chloride, based on silver, with any remaining halide being bromide, and (2) following step (1) completing grain growth under conditions that form the {100} major faces of the tabular grains, wherein, prior to step (2), (a) a solution containing elemental iodine is introduced into the dispersing medium, the iodine solution having a volume that is less than 10 percent the volume of the emulsion at the conclusion of step (2), (b) after 0.01 percent and before 3 percent of total silver has been introduced, the iodine is converted to iodide ion, and (c) the iodide is incorporated into the grain nuclei to create crystal lattice defects that promote the growth of {100} tabular grains during step (2).

2. A process according to claim 1 wherein during step (1) the pCl is maintained in the range of from 1.0 to 3.0.

3. A process according to claim 2 wherein during step (1) the pCl is maintained in the range of from 1.5 to 2.5.

4. A process according to claim 1 wherein the iodine solution accounts for less than 1 percent of the volume of the emulsion at the conclusion of step (2).

5. A process according to claim 1 wherein the iodine concentration added in step (a) amounts to up to 10 mole percent, based on silver.

6. A process according to claim 5 wherein the iodine added in step (a) amounts to at least 0.005 mole percent, based on total silver precipitated in steps (1) and (2).

7. A process according to claim 1 wherein step (a) occurs prior to introducing 1.5 percent of total silver into the dispersing medium.

8. A process according to claim 1 wherein during step (b) the pH of the dispersing medium is maintained in the range of from 3.5 to 8.

9. A process according to claim 8 wherein during step 6 the pH of the dispersing medium is maintained at less than 7.0.

* * * * *